United States Patent [19]

Jones et al.

[11] 4,344,627

[45] Aug. 17, 1982

[54] ALPHABET GAME

[76] Inventors: Jessie L. Jones, c/o George Spector, 3615 Woolworth Bldg., 233 Broadway; George Spector, 3615 Woolworth Bldg., 233 Broadway, both of New York, N.Y. 10007

[21] Appl. No.: 198,776

[22] Filed: Oct. 20, 1980

[51] Int. Cl.[3] ..... A63F 3/06

[52] U.S. Cl. ..... 273/273; 273/269

[58] Field of Search ..... 273/269, 273; 434/205

[56] References Cited

U.S. PATENT DOCUMENTS

| | | | |
|---|---|---|---|
| 1,061,999 | 5/1913 | Grondahl | 273/269 |
| 1,584,062 | 5/1926 | Williamson | 273/292 |
| 2,545,415 | 3/1951 | Podd | 273/273 |
| 3,982,763 | 9/1976 | Schlurensauer | 273/240 X |

*Primary Examiner*—Anton O. Oechsle

[57] ABSTRACT

A game device that includes a rectangular gameboard having diagonally extending rows of spaces between opposite corners thereof, and a set of cards for players to selectively place upon the spaces of their respective arms of the rows and a central space crossed by the diagonal rows, each defining a winner, and each card being printed alphabetically with a numeral such as that of a denomination on paper money, and the game also including a set of chips each of which is alphabetically printed so to represent the denomination amounts of the cards. The spaces in the arms and the center space are variously printed with numerals corresponding to the numbers printed alphabetically on the cards.

1 Claim, 2 Drawing Figures

ALPHABET GAME

This invention relates generally to board games.

A principal object of the present invention is to provide a board game for being played competitively between several players and wherein an alphabetic letter called out by a non-player informs the players to take a card related to the letter, and place it upon a space provided therefore upon a gameboard, a first player covering all his spaces being declared a winner.

Another object is to provide an alphabet game that can be easily played by both adults and children together.

Figure 1:
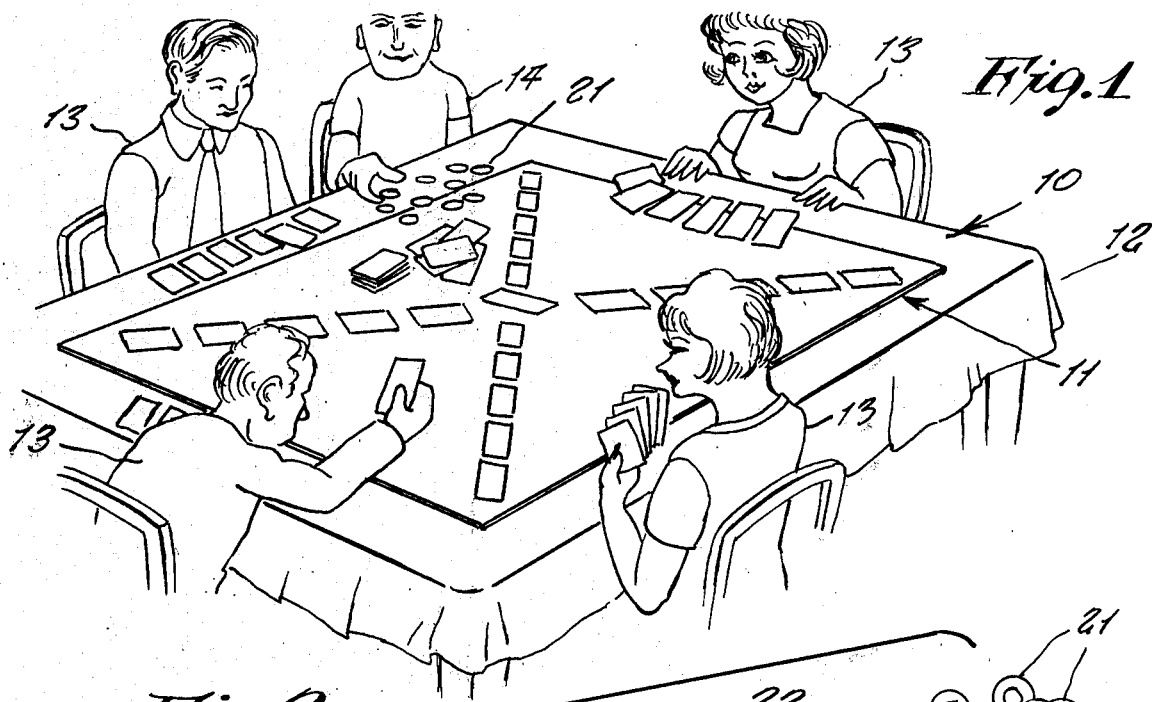
FIG. 1 is a perspective view of the game, shown being played.

Referring now to the drawing in greater detail, the reference numeral 10 represents an alphabet game, according to the present invention, wherein there is a gameboard 11 that measures preferably four by five feet in order to be large and yet fit upon a conventional rectangular table 12 such as is generally available in every home, and around which up to four players 13 may be seated, as well as a non-player 14 who calls out the alphabetical letters to the players.

Figure 2:
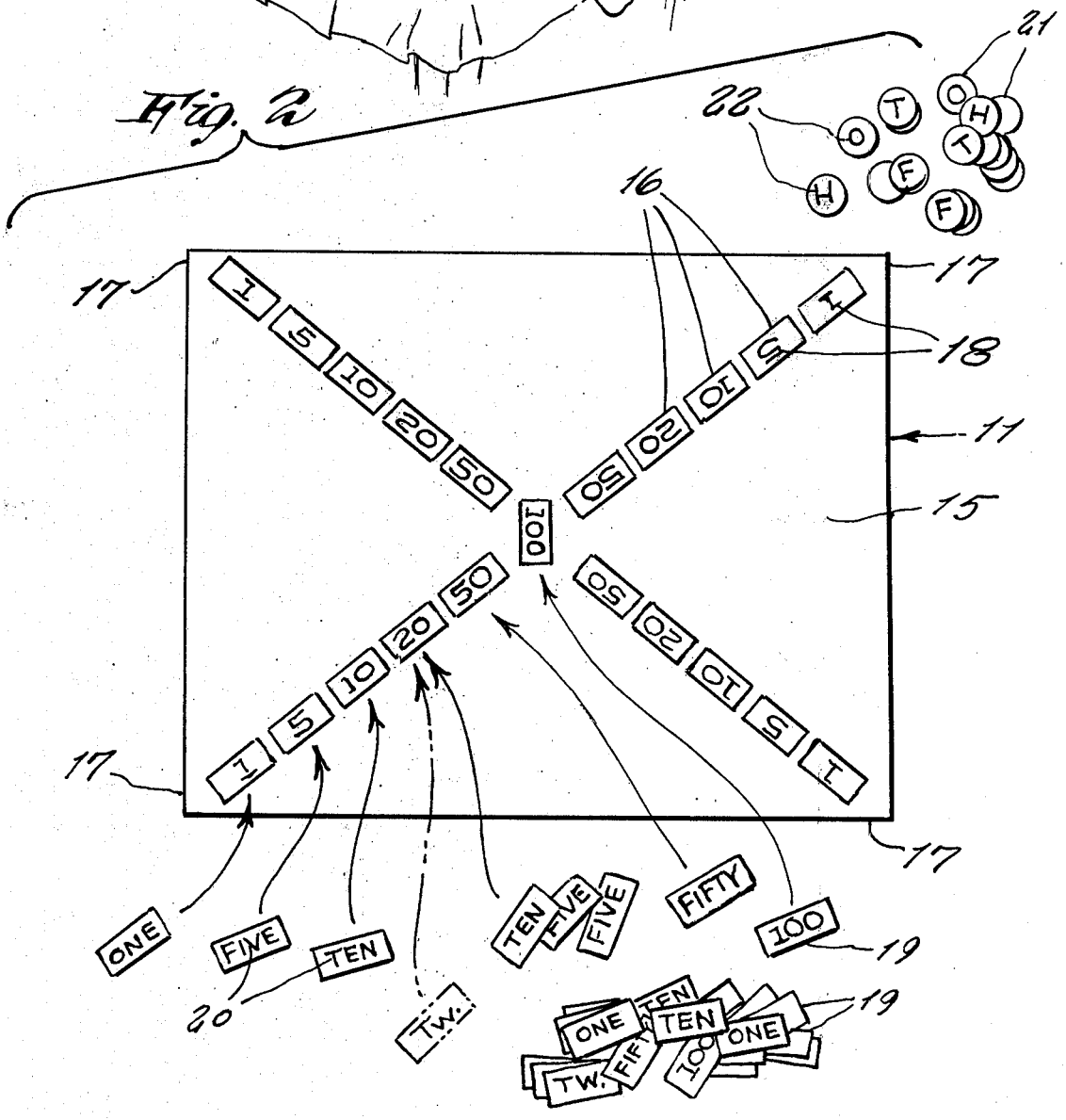
FIG. 2 is a top view thereof.

The gameboard is printed with a playing field 15 upon its upper side and which includes two diagonal rows of spaces 16 extending between opposite corners 17 of the gameboard. Each space is printed with a numeral, as shown at 18, that is as same as the numerical value of conventional paper money. Thus these numerals comprise 1,5,10,20,50 and 100. The central space has the numeral 100, while the five spaces between the center space and each corner space have the other numbers 1,5,10,20 and 50, starting in sequence from the corner space as shown in FIG. 2. Thus there are a total of twenty-one spaces on the gameboard, the spaces being rectangular shaped.

The game also includes a deck of cards 19, each card being printed on one side with an alphabetical word, as shown at 20; the words comprising either "one", "five", "ten" "twenty", "fifty" or "hundred". The deck includes a large plurality of each of these cards so to be available to all the players.

The game also includes a large set of chips 21, each of which on one side thereof is printed with an alphabetical letter, as shown at 22. Similarly to the cards, there are a large plurality of each of such designated chips in the game. The letter "o" on the chip represents a "one". The letter "F" represents either a "five" or "fifty". The letter "T" represents either a "ten" or "twenty". The letter "H" represents a "hundred".

In playing the game, the deck of cards is shuffled and six cards are dealt to each player. The chips are turned over with alphabet letters faced downwards. The chips are then shuffled.

The non-player then picks up the chips one at a time and after each calls out the letter printed on the chip. A first player then sees if he has a card having a word on it that starts with the letter that was called. If he does not have it, he then passes up his turn. A next chip is then called out, and a next player likewise sees if he has a card with word starting with same letter as has just been called. If he has such card he then places the card on the appropriate space. For example: if the letter that was called is an "0", and the player has a card printed with a "one", the player then places it on the space printed with a "1". If a letter "T" is called, the player can then put out either a "ten" or a "twenty" card, as he wishes, or whichever of these two spaces are available as yet to him in his own row of five spaces at his left and the center space. A first player to cover all spaces from "1" to "50" in his own row is declared a first winner of the game, and if he or any other player covers the center space printed with "100" the player then becomes a second winner. The two winners then divide between themselves a score of all points totaled by the cards all the other players have left in their hand. The above described rules may be changed, as wished, and other variations of game rules may be used, as preferred by players.

In one form of the game rules a "bone yard" of undealt cards are placed on the table, as shown at 23, and if a player cannot move a card out from his own hand, he then can pick up to three cards from the boneyard in hope of acquiring a card that he can use, however, such extra cards can limit his chance of winning in a game wherein a player must hold less than six cards to win.

What is claimed as new, is:

1. An alphabet game comprising in combination, a rectangular gameboard a deck of cards and a set of chips, said gameboard having rows of rectangular spaces marked with numerals, said cards each being printed alphabetically with a word indicating one said numeral, and each said chip being printed with a letter which is a first letter of one said word printed on said cards, wherein there are plurality of chips corresponding to each said word, wherein said rows on said gameboard extend diagonally between opposite corners of said gameboard and wherein said numerals are in ascending order of one to fifty, in combination with a central space with numeral 100 at the intersection of said rows defining one winner of said game, while any section of either said row between any said corner and said central space defines a second winner if said spaces are covered by appropriate said cards.

* * * * *